US005497705A

United States Patent [19]

Bredy et al.

[11] Patent Number: 5,497,705

[45] Date of Patent: Mar. 12, 1996

[54] ZONE-DEFENSE WEAPON SYSTEM AND METHOD FOR CONTROLLING SAME

[75] Inventors: Thierry Bredy, Asniéres les Bourges; Hervè Rodriguez, Meneton Salon; Emmanuel Marchand, Bourges, all of France

[73] Assignee: Giat Industries, Versailles, France

[21] Appl. No.: 341,584

[22] PCT Filed: Mar. 29, 1994

[86] PCT No.: PCT/FR94/00346

§ 371 Date: Nov. 21, 1994

§ 102(e) Date: Nov. 21, 1994

[87] PCT Pub. No.: WO94/24512

PCT Pub. Date: Oct. 27, 1994

[30] Foreign Application Priority Data

Apr. 15, 1993 [FR] France ..... 93 04429

[51] Int. Cl.[6] ..... F42B 23/16; F42B 23/04

[52] U.S. Cl. ..... 102/427; 89/1.11; 102/425

[58] Field of Search ..... 102/427, 428, 102/425; 89/1.11

[56] References Cited

U.S. PATENT DOCUMENTS

| | | | |
|---|---|---|---|
| 4,267,562 | 5/1981 | Raimondi | 358/109 |
| 4,738,411 | 4/1988 | Ahlström et al. | 244/3.15 |
| 4,817,495 | 4/1989 | Drobot | 89/1.11 |
| 5,012,717 | 5/1991 | Metersky et al. | 89/1.11 |
| 5,095,467 | 3/1992 | Olson et al. | 367/125 |
| 5,186,414 | 2/1993 | Holzschuh et al. | 244/3.12 |
| 5,198,614 | 3/1993 | de la Haye et al. | 102/401 |
| 5,261,328 | 11/1993 | de la Haye | 102/425 |

FOREIGN PATENT DOCUMENTS

| | | |
|---|---|---|
| 0518309 | 12/1992 | European Pat. Off. . |
| 2590663 | 5/1987 | France . |
| 2607585 | 6/1988 | France . |
| 2667139 | 3/1992 | France . |
| 2667389 | 4/1992 | France . |
| 2090950 | 7/1982 | United Kingdom . |
| 2251058 | 6/1992 | United Kingdom . |

*Primary Examiner*—Charles T. Jordan
*Assistant Examiner*—Christopher K. Montgomery
*Attorney, Agent, or Firm*—Oliff & Berridge

[57] ABSTRACT

A zone-defense weapon system includes an attack device having at least one main launch tube having a projectile that encloses an explosive charge. At least one device for surveillance and acquisition of targets controls a surveillance zone by detecting an objective target penetrating into the surveillance zone, and by controlling firing of the main projectile in the direction of the detected objective target. The attack device is located at a remote distance from the surveillance and target-acquisition device, and the surveillance zone is within the action radius of the attack device. The surveillance device may include an auxiliary projectile fired from the attack device.

18 Claims, 2 Drawing Sheets

FIG.4
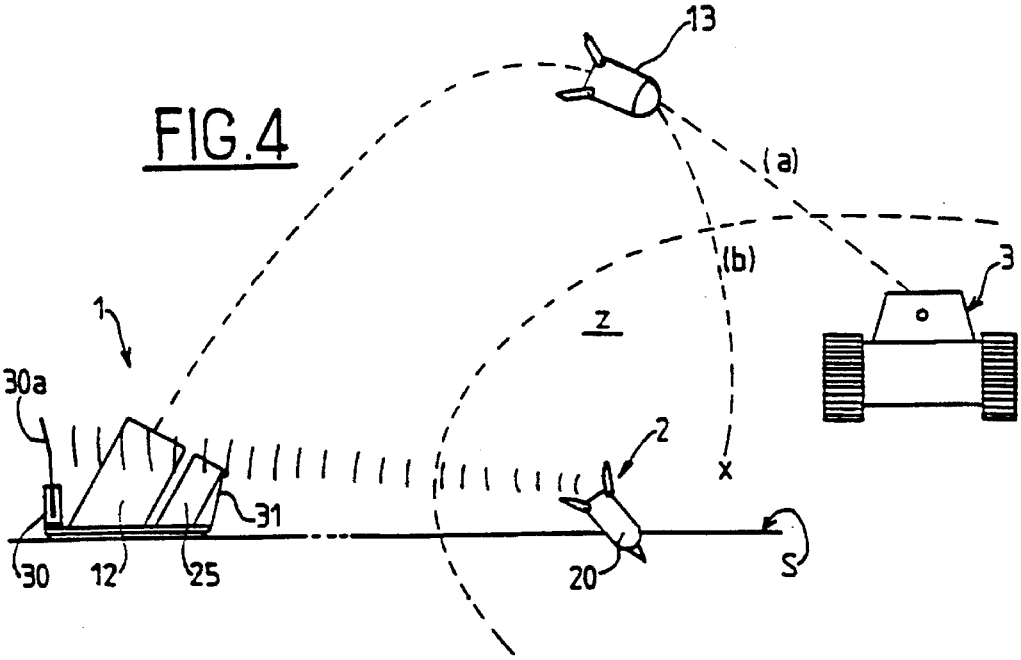
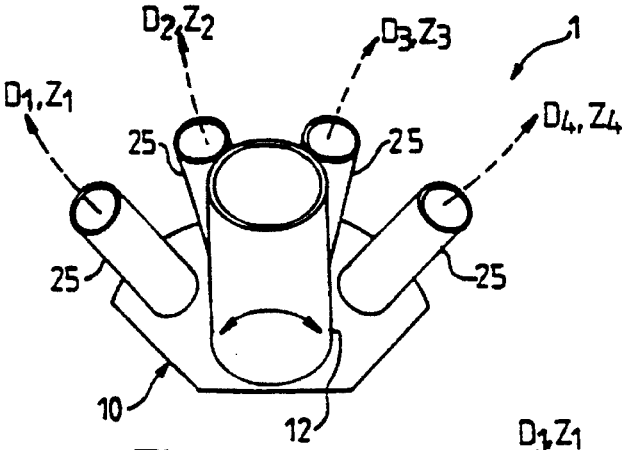
FIG.5
FIG.6
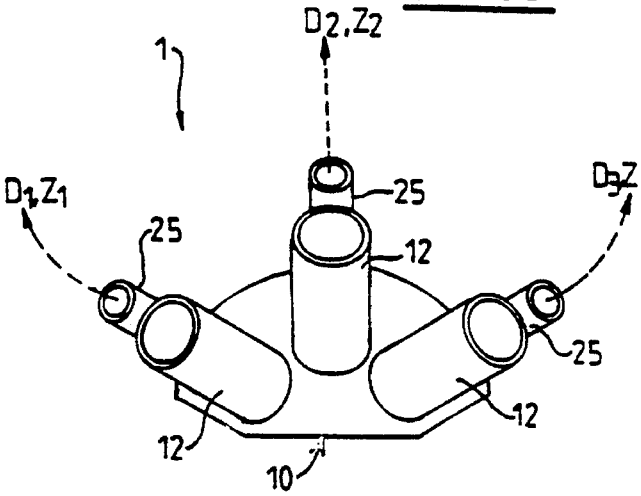

ZONE-DEFENSE WEAPON SYSTEM AND METHOD FOR CONTROLLING SAME

The present invention concerns a zone-defense weapon system of the type having of an attack device including at least one ammunition-launch tube whose projectile encloses, for instance, one or several explosive charges and at least one surveillance and target-acquisition device that controls a surveillance zone by detecting an objective target penetrating in said the zone and controlling the attack device to fire the ammunition toward the detected target.

Patent FR-2 667 139 describes a space-barrage system for reconnaissance and warfare against land-based targets. This system provides for the installation of detectors in one zone, and, on the other hand, the transmission of active elements such as mines from another zone.

The detectors and active bodies are sent at different times and by different carriers, such as rockets.

A system like this is complex to implement because it requires the use of heavy equipment such as artillery rocket launchers. It is adapted to the creation of barrages at long distances.

The detectors that are sent are set out on the group in a random manner. To ensure a certain amount of efficiency, a large number of ammunitions have to be sent into the zone or ammunition provided with complex correction devices are required, which devices allow target detection or trajectory correction.

This invention is not aimed at any such heavy-defense system, but rather as a zone-defense weapon system or zone-defense mine capable of causing aggression upon the target or objective, such as a tank, for instance, in a surveillance zone whose action radius is between several tens and several hundreds of meters.

Such a zone-defense weapon system is more often than not directly set up by an operator within the surveillance zone. The attack device and the surveillance and target-acquisition device are mounted on a platform stabilized on the ground by feet, and the surveillance and a target-acquisition device, based on sensors, is deployed automatically or by the operator.

During operation, the surveillance and target-acquisition device, once activated, is designed to detect, locate and identify targets penetrating the surveillance zone. The captured signals are analyzed by a processing electronic device that may control a device for orienting the attack-device ammunition-launch tube in elevation and/or azimuth, before controlling a projectile propulsion-charge ignition device.

Once the projectile has been launched on its trajectory, an on-war detection device scans the ground, and an explosive charge, such as a core-generating charge is fired from the projectile toward the target once it has been detected.

The efficiency of these zone-defense weapon systems is connected more particularly to the performance of the surveillance and target-acquisition device, bearing in mind that such systems are also put under two constraints concerning their camouflage on the one hand, and their reuse on the other hand, such reuse being mandatory when they have not operated during their programmed activity time, and requiring their prior recuperation, if possible, under conditions that do not involve lengthy and tedious operations.

A zone-defense weapon system of the aforementioned type is described in Patent FR-2 607 585. In this system, the surveillance and target-acquisition device includes a seismic sensor pushed into the ground, and three microphones placed respectively at the ends of three bars extended in the form of a triangle. The target is detected by a seismic sensor, and its location is calculated by processing electronics from a measurement of the phase shifts between the various signals picked up by the microphones.

To improve the efficiency of target location, the triangle formed by the three microphones must be enlarged, for instance, possibly to the detriment of system camouflage. Alternatively the performance of the processing electronics can to be improved, as envisioned in U.S. Pat. No. 5,095,467.

U.S. Pat. No. 5,095,467, discloses the use of processing electronics using digitized signals from various microphones to improve the efficiency of the surveillance and target-acquisition device as a result of improved processing of capacities. However, the required electronics are complex, which considerably increases the cost of manufacturing such systems.

Finally, in Patent EP-518 309, a mine is described whose surveillance and target-acquisition device microphones are deployed around the mine and connected to it by cables. If it is possible to increase the surface contained within these microphones in this way, without any detrimental effect upon the camouflage of the mine, the recovery of the mines that have not operated during their programmed activity period is not made any easier.

SUMMARY OF THE INVENTION

One purpose of this invention is to overcome the drawbacks of the aforementioned zone-defense weapon systems while satisfying the constraints of camouflage and reuse using a new design zone-defense system having a central structure and low-cost manufacturing.

Accordingly, this invention proposes a zone-defense weapon system including:

- at least one surveillance and target-acquisition device controlling a surveillance zone to detect any targets penetrating into it,
- an attack device having at least one launch tube for a main projectile whose firing, toward the detected target, is controlled by the surveillance and target-acquisition device,
- the attack device is located at a distance from the surveillance and target-acquisition device, and the surveillance zone is located in the action radius of the attack device.

Each surveillance and target-acquisition device includes an auxiliary projectile fired toward the surveillance zone using of an auxiliary launching tube for the attack device while the main projectile, fired by the attack device, is designed to arrive within the surveillance zone in the immediate neighborhood of the surveillance and target-acquisition device.

With arrangements like this, it is no longer necessary to use complex electronics to determine the target location. The system is designed in such a way the the main projectile reaches the ground at a theoretical point located immediately near the point of impact of the detector on the ground, and it is simply necessary for the detector to control the firing of the main projectile so that it reaches the neighborhood of the detected target.

In another embodiment of the invention, the attack device could be located outside of the surveillance zone.

An arrangement like this improves camouflage of the device and makes the enemy mine-clearing operations more complex.

In an initial embodiment of the invention, the system includes several surveillance and target-acquisition devices that control several surveillance zones, and the attack device includes a tube that can be pointed toward the surveillance and target-acquisition device, controlling the firing order of the main projectile.

In this case, the main-projectile launch tube of the attack device may be adjustable in elevation and/or in azimuth to point the launching tube toward the surveillance and target-acquisition device, which gave the firing order.

In another embodiment of the invention, the system may also include several surveillance and target-acquisition devices that control several surveillance areas, but the attack device may include several mainprojectile launch tubes, while each surveillance and target-acquisition device is then dedicated to one launch tube.

In the latter case, the main-projectile launch tubes are not necessarily equipped with devices for orienting them elevation and/or in azimuth.

Therefore, according to the invention, the surveillance zone located within the field of efficiency of the attack device can be split into several surveillance zones that do not necessarily overlap one another, while each of these zones can be of a small area in order to improve the efficiency of the surveillance and target-acquisition device that controls it, without recourse to complex detection devices being necessary.

Under these conditions, when a target penetrates any of these surveillance zones, the surveillance and target-acquisition device controlling that zone may simply detect the presence of the target without it being necessary to localize it.

Depending upon the variant used, it will then be a simple matter of:

- either pointing the launch tube of the main projectile of the attack device toward the surveillance and target-acquisition device that gave the firing order,
- or ordering the firing of the main projectile contained in the launch tube which points toward the surveillance device in question.

A main projectile may have an efficiency area at least equal to the surveillance area in question.

This means that for an explosive projectile not having any target detection device, the explosive charge will have an efficiency area at least equal to the surveillance area in question.

This also means that for a projectile having target detection devices (such as a projectile of the type described in the patents GB-2 090 950 or FR-2 590 663), the detection devices scan an area at least equal to the surveillance zone in question.

In other words, and for some applications, it is possible to simplify on the one hand, the structure of the surveillance and target-acquisition device by limiting its function to one of detection and on the other hand, simplifying the projectile in itself, because it is then no longer necessary to provide, within the projectile, target detection devices and, if necessary, trajectory correction facilities.

According to the system in conformity with the invention, the aforementioned camouflage constraints are also satisfied. Indeed, the auxiliary projectile ensuring the surveillance and target-acquisition function is of compact size.

In addition, the auxiliary projectile does not require the deployment of auxiliary devices needed for its operation, making it all the more easy to recover the small-size surveillance devices, which are of low cost and can be abandoned in the field.

It is an advantage in that each auxiliary projectile forming the surveillance and target-acquisition device has at least one acoustic, seismic or magnetic sensor to detect the presence of an objective target penetrating the surveillance area with processing electronics to analyze the signals received by the sensor, a device transmitting a warning signal to a reception device in the attack device, and a source of electric energy.

In one variant of the invention, the attack device reception device can give the firing order for the auxiliary projectile in response to an activation order transmitted by the operator at a distance.

It is advantageous for the attack device to include a long-range warning device to monitor the approach of an objective target at distances greater than that where the surveillance zone is to be located, and give the order to fire the auxiliary projectile.

The firing of the auxiliary projectile can be provoked automatically after an electronic or pyrotechnical set delay or the firing can be programmed when the system is installed.

BRIEF DESCRIPTION OF THE DRAWINGS

Other advantages, characteristics and details of the invention will be revealed in the explanatory description which follows, with reference to the attached illustrations given purely as examples, and in which:

FIG. 4 is a similar view to FIG. 1 to illustrate the operation of the zone-defense weapon system according to the invention, and FIGS. 5 and 6 are schematic illustrations of two methods of obtaining the invention, respectively.

DETAILED DESCRIPTION OF PREFERRED EMBODIMENTS

Figure 1:
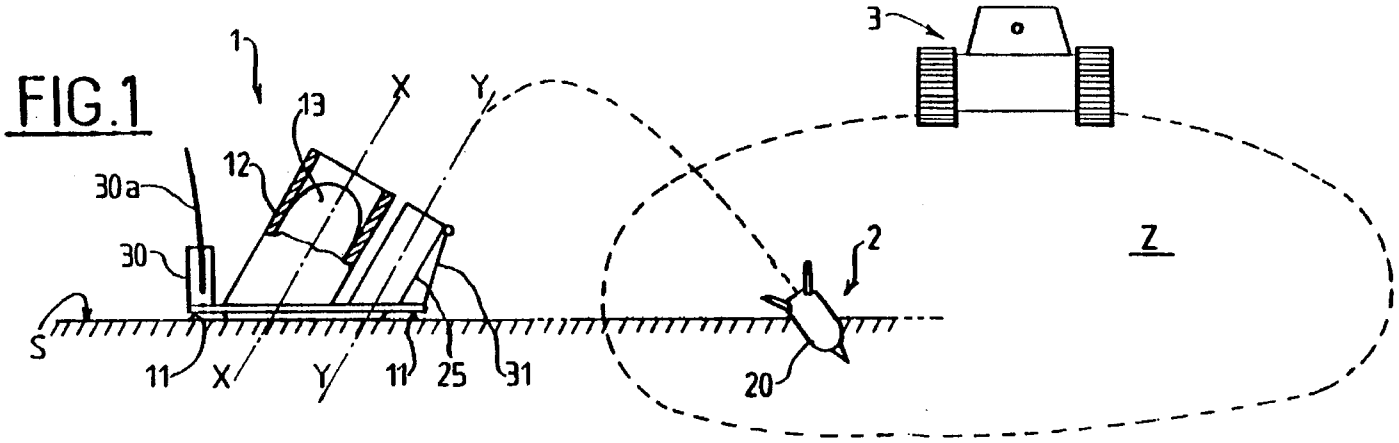
FIG. 1 is a schematic view of a zone-defense weapon system according to the invention.

A zone-defense weapon system according to the invention and as illustrated in FIG. 1 includes an Attack Device 1 and a Surveillance and Target-Acquisition Device 2 detecting Target 3 entering a Surveillance Zone Z under the control of the Surveillance and Target-Acquisition Device 2 and which is located within the action radius of Attack Device 1.

According to an essential characteristic of the invention, Attack Device 1 and Surveillance and Target-Acquisition Device 2, hereinafter referred to as Surveillance Device 2, are separated from one another. More specifically, Surveillance Device 2 is located in the Surveillance Zone Z, of which it is in control, whereas Attack Device 1 is at a distance from Surveillance Device 2, and can be located, advantageously, outside of Surveillance Zone Z, as is the case of the example of FIG. 1. The Attack Device i is supported by a Platform 10 stabilized on Ground S by Feet 11, and has at least one Launch Tube 12 for ammunition including of a propulsive charge and a Main Projectile 13 enclosing at least one explosive charge designed Co aggress a Target 3 entering Surveillance Zone Z. Surveillance Zone Z is located, essentially and entirely within the action radius of the attack device, meaning that a projectile launched by the latter is liable to aggress any target to be found in this Zone Z.

In general, Platform 10 can be equipped with a device (not shown) for adjusting the launch tube in elevation and azimuth, or in azimuth only.

Figure 3:
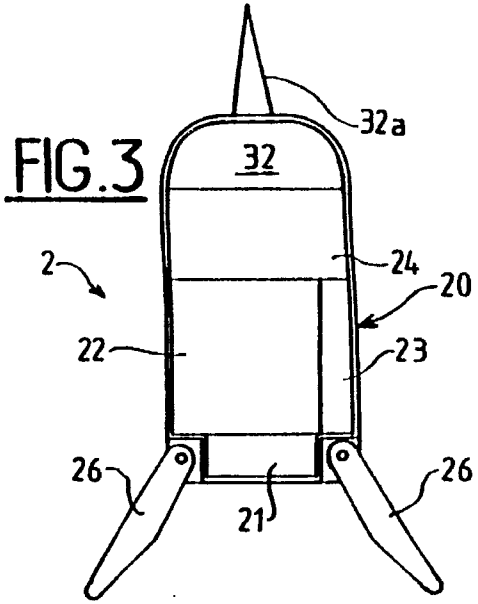
FIG. 3 is a schematic view of the surveillance and target-acquisition device of a zone-defense weapon system according to the invention.
Figure 2:
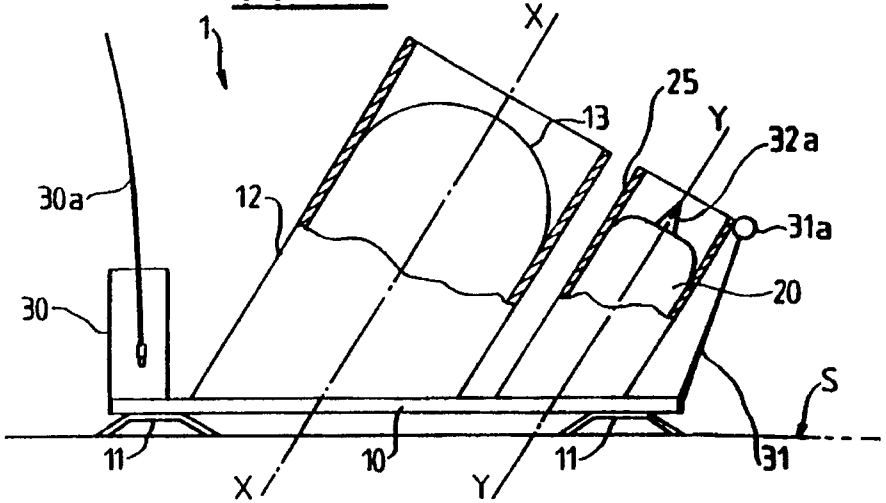
FIG. 2 is a schematic view of the zone-defense weapon system attack device of FIG. 1.

According to another aspect of the invention, Surveillance Device 2 shown in FIG. 3 consists of an Auxiliary Projectile 20 containing, more particularly:

one or several Sensors 21 of the acoustic, seismic or magnetic types, a Processing Unit 22 processing for the signals received by Sensors 21, a Device 23 transmitting a warning to the Attack Device 1, which warning can be a radio, audible or ultrasonic signal, and a Source or Electric Energy 24.

The Auxiliary Projectile 20 is fired from Attack Device 1 using an Auxiliary Launch Tube 25 integral with the attack device , and it is also equipped with Stabilization Fins 26 that extend as the axillary projectile leaves its Launch Tube 25.

Attack Device 1 is also equipped with a Reception Device 30 having an Antenna 30a designed to pick up the warning signal transmitted by Surveillance Device 2, and which triggers the firing of Projectile 13.

A Long-Range Warning Device 31 can be mounted on Platform 10 of Attack Device 1, and includes a Detection Device 31*a* such as a microphone, monitoring the approach of a Target 3 at distances exceeding those where Surveillance Zone Z should be located. This Long-Range Warning Device 31 is designed to control the launching of Auxiliary Projectile 20, and to put the weapons system on standby.

According to a simplified method (FIGS. 1 and 4), Launch Tube 12 of the Attack Device 1 is aligned on an axis X—X corresponding to a determined angle of elevation. Launch Tube 25 of Auxiliary Projectile 20 is oriented along an axis Y—Y arranged in the same vertical plane as the axis X—X. The axes X—X and Y—Y are shown parallel here.

The angle between the axes X—X and Y—Y is determined according to the mass and geometry of the Projectiles 13 and 20 and according to the propulsive charges of these projectiles so that, with the two projectiles having more or less the same point of impact on the ground, the ballistics of Projectiles 13 and 20 can be different.

It is not necessary for the theoretical points of impact of the main projectile and auxiliary projectile on the ground to be identical; it is sufficient that these theoretical points are sufficiently close to one another for the main projectile to be capable of aggressing, with sufficient probability, a target that is detected by the auxiliary projectile.

It might be considered advantageous to give the main projectile an efficiency area whose surface is equal, at least, to that of the detection area.

The relative angles of axes X—X and Y—Y with respect to vertical may, if necessary, be modified in the field so as to adapt the system to particular constraints. For instance, if the projectile ground-impact point has to be at an altitude other than that where the platform is located (below or above).

Graphs and firing tables can be drawn up to facilitate fast adjustment in the field.

The theory of operation of this simplified method will be explained below with reference to FIGS. 1 to 4.

Once Attack Device 1 has been set up by the operator, an Auxiliary Projectile 20, forming Surveillance Device 2, is fired from the Auxiliary Launching Tube 25. Firing occurs conventionally by the firing of a propulsive charge, and the firing conditions are determined so that impact upon the ground of Projectile 20 occurs at a point which can be defined accurately.

The position on the ground of Auxiliary Projectile 20 is essential because it determines the position of Surveillance Zone Z. Accordingly, Auxiliary Projectile 20 is equipped, for instance, with an Ogive 32 having a reduced diameter and high mechanical resistance so that it is able to penetrate into Ground S and prevent rebound on impact against ground while Ogive 32 can be extended by a Nose Cone 32*a*. As an alternative, it is possible to define an Ogive 32 which crushes on impact upon hard ground in order to dampen the shock and also to avoid rebounding of Auxiliary Projectile 20.

The firing of Auxiliary Projectile 20 can be controlled from an activation order sent:

by the Long-Range Warning Device 31 or by Reception Device 30, which captures the signals emitted by a transmitter located at a distance so that an operator can remote control firing while the signals then have different frequencies or a specific code so that Reception Device 30 may distinguish between an activation order (firing of Auxiliary Projectile 20) and a warning signal (firing of Main Projectile 13).

As an alternative, it is possible to provoke automatic firing of the Auxiliary Projectile 20 after an electronic or pyrotechnical delay, whether fixed or programmable, at the time the weapon system is installed.

Surveillance Device 2 formed by Auxiliary Projectile 20 is then activated by the initiation of its Energy Source 24 to detect a Target 3 which penetrates the Surveillance Zone Z and whose presence is detected by the Sensors 21.

The signals from the Sensors 21 are analyzed by the Processing Unit 22, which confirms the presence of Target 3 to be aggressed. Electronics 22 then control the transmission of a warning signal, which is sent by Device 23 (FIG. 4). This warning can be, for instance, a radio signal which will be picked up by Antenna 30*a* of Reception Device 30 in order to trigger the firing of Main Projectile 13 toward Surveillance Zone Z.

In the case of a Main Projectile 13 equipped with means of detection, the explosive charge will be fired along a trajectory (a) to directly destroy Target 3, which it will identify itself with its own means of detection, within Surveillance Zone Z.

It is also possible to fire a Main Projectile 13 having no target-detection means. It will then follow a trajectory (b), bringing it to impact upon the ground near Surveillance Device 2. The charge in this main projectile can be initiated by an impact contactor or by a fuse (of the timed type or detecting the proximity of the ground).

This charge is chosen in such a way that its area of efficiency is at lease equal to that of Surveillance Zone Z, thus ensuring aggression of Target 3.

The charge of the main projectile can also include submunitions such as anti-tank small bombs dispersed above the Surveillance Zone Z. This alternative is particularly simple and economical because Projectile 13 does not require target-detection devices that are complex or costly.

Using this zone-defense weapon system, it is possible to design two embodiments to improve efficiency.

In one embodiment illustrated in FIG. 5, Attack Device 1 is equipped with several Launch Tubes 25 of an Auxiliary Projectile 20, in the present case four, by means of which it is possible to fire four Surveillance Devices 2 in four different directions D1, D2, D3 and D4, to define four Surveillance Zones Z1, Z2, Z3 and Z4, respectively. Attack Device 1 is only equipped with a single Launch Tube 12 for a main projectile, and it is essential that this Launch Tube 12 be adjustable, which adjustability can be accomplished in a conventional manner.

If all the Surveillance Devices 2 are fired at the same elevation angle, it will be simply necessary to provide for Launch Tube 12 the possibility of azimuth orientation. If the surveillance devices are not all fired at the same elevation angle, Launch Tube 12 will be adjustable in elevation and azimuth. It is essential that in all cases, Projectile 13 is launched toward Surveillance Zone Z, for which the surveillance device has transmitted a warning signal.

In the second embodiment illustrated in FIG. 6, Attack Device 1 includes several Launch Tubes 12 of a main projectile, and an equal number of Launch Tubes 25 for an Auxiliary Projectile 20. In this case, each Surveillance Device 2 is dedicated to a Launch Tube 25, while the warning signal transmitted by one of the Surveillance Devices 2 is accompanied by the identification code of Launch Tube 12 associated with it, and which has to fire the main projectile.

At this point, there is no need to provide for Adjustable Launch Tubes 12 for the main projectiles.

Indeed, each of these tubes is dedicated to a specific surveillance device, and on setting up, it will have received the appropriate orientation to ensure, on firing, the arrival on the ground of the main projectile in question near the associated surveillance device.

These two different methods define a larger surveillance zone including several zones separate from one another.

Transmitting a warning signal by radioelectric or audible channels provides for transmission, without intervisibility, between Surveillance Device 2 and Attack Device 1, thus facilitating the camouflage of the Attack Device 1.

In another embodiment, Attack Device 1 will be placed outside of Surveillance Zone Z, but it will be possible to define a weapon system within which Attack Device 1 is located within Surveillance Zone Z, for instance, near a border. A system of this type would operate correctly if Main Projectile 13, launched by Attack Device 1, is capable of aggressing any target to be found in Surveillance Zone Z.

As an alternative, it is possible to define an anti-personnel type defense system in which the surveillance device is designed to detect the presence of people and the attack system launches explosive-fragment projectiles or incapacitating projectiles (of the neutralizing audible or gas-dispersing types).

Finally, it is possible to apply the invention to a field artillery-type weapon system (or mortar) in which the surveillance devices located an a great distance (on the order of several kilometers) from the attack device including for instance, an artillery battery. The warning signal supplied by the surveillance device at low power could then be relayed by retransmitting stations placed at an intermediate distance between the surveillance device and the attack device. As an intermediate station, it would be possible to use small remote-controlled surveillance aircraft.

We claim:

1. A zone-defense weapon system comprising:

at least one surveillance and target-acquisition device for controlling a surveillance zone to detect an objective target entering into said surveillance zone;

an attack device having at least one main projectile launch tube and at least one auxiliary launch tube, said at least one surveillance and target-acquisition device controlling actuation of the attack device in a direction of the objective target;

wherein the at least one surveillance and target-acquisition device is a remote distance from the attack device, the surveillance zone being located in an action radius of the attack device, and wherein said at least one surveillance and target-acquisition device includes an auxiliary projectile that is fired from said at least one auxiliary launch tube of said attack device and lands within said surveillance zone, and said at least one main projectile is fired from said at least one main projectile launch tube and falls within the surveillance zone adjacent said at least one surveillance and target-acquisition device.

2. The zone-defense weapon system according to claim 1, wherein the at least one main projectile has an efficiency zone at least equal in size to the surveillance zone.

3. The zone-defense system according to claim 1, wherein the attack device is located outside of said surveillance zone.

4. The zone-defense weapon system according to claim 1, wherein said at least one surveillance and target-acquisition device comprises a plurality of surveillance devices that control several respective surveillance zones, and wherein the at least one main projectile launch tube is adjustably mounted so as to point toward a selected surveillance zone of said plurality of surveillance zones in which said objective target is detected, a selected surveillance device of said plurality of surveillance devices being operable to initiate deployment of said at least one main projectile into said selected surveillance zone.

5. The zone-defense weapon system according to claim 1, wherein said at least one surveillance and target-acquisition device comprises a plurality of surveillance devices and said at least one main projectile launch tube comprises a plurality of projectile launch tubes associated with said plurality of surveillance devices.

6. The zone-defense weapon system according to claim 1, wherein said auxiliary projectile includes at least one sensor for producing signals in accordance with signals received from said objective target, processing electronics to analyze said signals received by said sensor, a warning device for transmitting a warning signal toward a reception device of the attack device, and an electric energy source for providing power to said sensor, said processing electronics and said warning device.

7. The zone-defense weapon system according to claim 6, wherein the reception device of the attack device is controllable to fire said auxiliary projectile in response to an activation order sent from a distance by an operator.

8. The zone-defense weapon system according to claim 6, wherein said attack device includes a long range warning device for monitoring said objective target when the objective target approaches from distances greater than a distance where said surveillance zone is located, and for providing a firing signal to said auxiliary projectile.

9. The zone-defense weapon system according to claim 6, wherein the auxiliary projectile is automatically activated after one of an electronic delay and one of a fixed and programmable power technical delay when initially installing the zone-defense weapon system.

10. The zone-defense weapon system according to claim 6, wherein said sensor comprises one of an acoustic sensor, a seismic sensor and a magnetic type sensor.

11. The zone-defense weapon system according to claim 1, wherein said at least one main projectile launch tube and said at least one auxiliary launch tube are mounted on a common platform.

12. The zone-defense weapon system according to claim 11, wherein said at least one surveillance and target-acquisition device directly signals a reception device mounted on said platform after the at least one surveillance and target-acquisition device has landed in said surveillance zone.

13. The zone-defense weapon system according to claim 1, wherein the zone-defense weapon system is automated.

14. A method for controlling a zone-defense weapon system having at least one surveillance and target-acquisition device and an attack device, said method comprising:

firing said at least one surveillance and target-acquisition device into a surveillance zone;

monitoring objective targets in said surveillance zone after said at least one surveillance and target-acquisition device has landed in said surveillance zone;

signalling said attack device to deploy a projectile into said surveillance zone when the at least one surveillance and target-acquisition device signals a reception device attached to and operatively coupled to said attack device; and providing a plurality of surveillance and target-acquisition devices and providing an attack device corresponding to each of said surveillance and target-acquisition devices, wherein respective ones of said surveillance and target-acquisition devices directly signal corresponding ones of said attack devices when an objective target is sensed in corresponding surveillance zones.

15. The method o claim 14, further comprising automatically firing the projectile when the reception device receives a signal.

16. A method for controlling a zone-defense weapon system having at least one surveillance and target-acquisition device and an attack device, said method comprising:

firing said at least one surveillance and target-acquisition device into a surveillance zone;

monitoring objective targets in said surveillance zone after said at least one surveillance and target-acquisition device has landed in said surveillance zone;

signalling said attack device to deploy a projectile into said surveillance zone when the at least one surveillance and target-acquisition device signals a reception device attached to and operatively coupled to said attack device; and mounting a main launch tube or said projectile and an auxiliary tube for said surveillance and target-acquisition device on a common platform.

17. The method of claim 16, further comprising providing a plurality of said surveillance and target-acquisition devices, wherein the firing step includes firing the plurality of surveillance and target-acquisition devices into respective surveillance zones, and wherein said attack device is movable to fire said projectile into one of said respective zones upon receiving a signal from one of said surveillance and target-acquisition devices.

18. The method of claim 16, further comprising providing a plurality of surveillance and target-acquisition devices and providing an attack device corresponding to each of said surveillance and target-acquisition devices, wherein respective ones of said surveillance and target-acquisition devices directly signal corresponding ones of said attack devices when an objective target is sensed in corresponding surveillance zones.

* * * * *